United States Patent [19]

Braun et al.

[11] Patent Number: 4,641,515

[45] Date of Patent: Feb. 10, 1987

[54] INTERMEDIATE STORAGE IN A TRANSFER PRESS

[75] Inventors: Hermann Braun, Eislingen; Helmut Dumschat, Donzdorf; Kurt Strommer, Kuchen; Sieghard Mueller, Ottenbach, all of Fed. Rep. of Germany

[73] Assignee: L. Schuler GmbH, Goeppinger, Fed. Rep. of Germany

[21] Appl. No.: 710,089

[22] Filed: Mar. 11, 1985

[30] Foreign Application Priority Data

Mar. 20, 1984 [EP] European Pat. Off. ..... 84103029.9

[51] Int. Cl.[4] ..... B21J 13/08

[52] U.S. Cl. ..... 72/405; 72/426; 72/419; 269/266; 269/296

[58] Field of Search ..... 72/405, 426, 419; 198/345; 269/266, 296, 40; 108/96

[56] References Cited

U.S. PATENT DOCUMENTS

| | | | |
|---|---|---|---|
| 319,133 | 6/1885 | Schmitt et al. | 108/96 |
| 2,322,368 | 6/1943 | Lacey | 269/296 |
| 2,399,824 | 5/1946 | Pressman | 269/266 |
| 2,518,867 | 8/1950 | Clary | 269/266 |
| 2,736,936 | 3/1956 | Gruenberg et al. | 269/266 |
| 4,200,272 | 4/1980 | Godding | 269/266 |
| 4,503,766 | 3/1985 | Hacker et al. | 72/405 |

FOREIGN PATENT DOCUMENTS

| | | | |
|---|---|---|---|
| 48306 | 6/1983 | Japan | 72/426 |

*Primary Examiner*—Daniel C. Crane

*Attorney, Agent, or Firm*—Barnes & Thornburg

[57] ABSTRACT

An intermediate storage in a press in which intermediate storages are to be provided within the area of idling stages thereof. The intermediate storages include storage templates matched to the shape of the bottom side of the workpieces which are adapted to be liftable in the vertical direction by way of lifting means. The lifting means may thereby act on the storage templates in the sense of a lifting movement, for example, by way of intermediate members displaceable by a motor-driven spindle, which act on the storage templates in the sense of a lifting movement by way of counter-abutment surfaces disposed at the ends of the storage templates.

12 Claims, 7 Drawing Figures

2
1
4
6
39
21
42
28
43
47
41
48
49
44
46
50
5
8
51
52
VI

INTERMEDIATE STORAGE IN A TRANSFER PRESS

The present invention relates to an intermediate storage for essentially large-surface workpieces within the area of an idling stage in the workpiece passage effected by a transport or conveyance apparatus of a transfer press with at least two storage templates or jigs per workpiece of different configuration having a support matched in the support area corresponding to the bottom surface of the workpiece.

In transfer presses such as double-column presses or multi-column presses, the length of the translatory movement of the workpieces is adjusted by way of the drive of the conveying or transporting apparatus. As a result of the idling stage between two press columns the distance between, for example, the third working stage and the fourth working stage in a multi-column press is larger than, for example, twice as large as the distance between the adjacent working stages which are actuated by a single ram. Within this area of the idling stage, a storage has to be provided in which workpieces can be temporarily put down by the conveying or transporting apparatus and be picked up again.

In the publication, "Einzelpressen und mechanisierte Einzelpressen" [Single Presses and Mechanized Single Presses] by H. L. Hilbert in the publication *Blech, Rohre, Profile* 26 (1979) 8, pages 384 and 385, a two-column press is described with an intermediate storage illustrated in FIG. 11 within the area of the workpiece delivery between two press columns. The intermediate storage includes two storage templates on which a workpiece is deposited by way of a conveying or transporting apparatus and picked up anew for delivery to a punching press arranged downstream of the press. If the work tool set is exchanged for a new workpiece, also the intermediate storage, respectively, the storage templates have to be manually exchanged. If such an intermediate storage is located between two columns—within the area of the idling stage—of a multi-column press, an increased expenditure is necessary for the exchange with unfavorable accessibility.

A multiple-die or gang press for large parts is described in the DE-PS No. 32 45 603 having an intermediate storage which consists of several small-area support elements which are adapted to be adjusted in height corresponding to the configuration of the bottom surface of the workpiece by means of piston rods or threaded spindles. This storage is adjustable to differently shaped workpieces and thus need not be exchanged with a work tool change. With the use of a press having an enclosure box between the press columns, such a storage installation cannot be used for space reasons. The height adjustment, devoid of abutments, of each displacement piston therebeyond requires a correspondingly large control expenditure.

The object of the present invention resides in the creation of an intermediate storage within the area of idling stages in presses of the type described hereinabove which does not entail the aforementioned disadvantages, which can be used also in presses with closure boxes and which, for reaching the desired position of the storage templates, is adapted to be displaced in height by the use of piston abutments.

The underlying problems are solved in accordance with the present invention with an intermediate storage of the aforementioned type in that the storage templates or jigs are movable and liftable by way of lifting means at least in the vertical direction, and in that at least one adjusting means is provided for a relative movement between the storage templates to be respectively lifted and the lifting means.

The advantages of the present invention reside in that with work tool changes, the starting, lifting and lowering of the storage templates is completely automated and the exchange and readjusting operations are thereby completely dispensed with. The control expenditure is reduced to a positioning of the storage templates to be lifted and the lifting operation against an abutment.

These and other objects, features, and advantages of the present invention will become more apparent from the following description when taken in connection with the accompanying drawing which shows, for purposes of illustration only, several embodiments in accordance with the present invention, and wherein.

Figures 5, 5A:
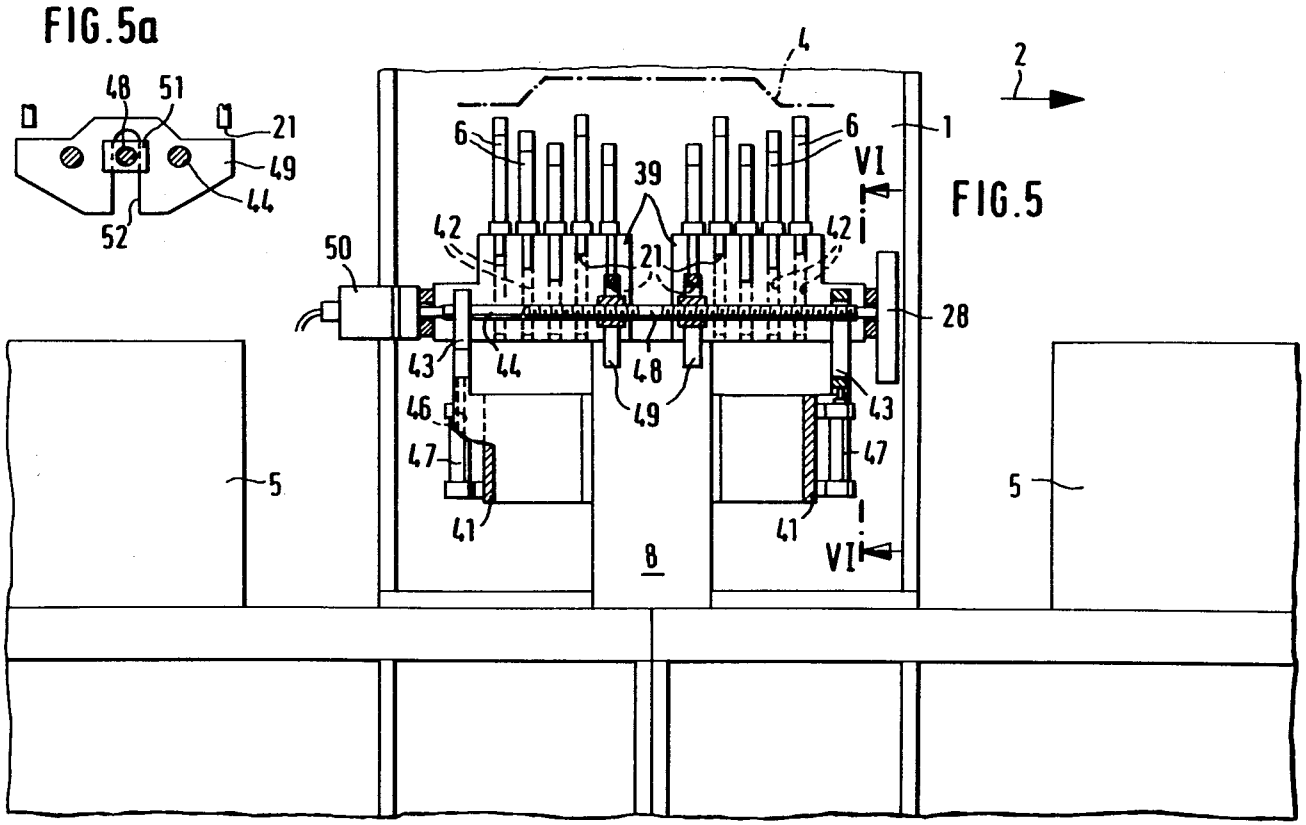
FIG. 5 is a front elevational view of a further modified embodiment of an intermediate storage installation in accordance with the present invention.

FIG. 5*a* is a side view of the lifting mechanism of FIG. 5; and

Figure 6:
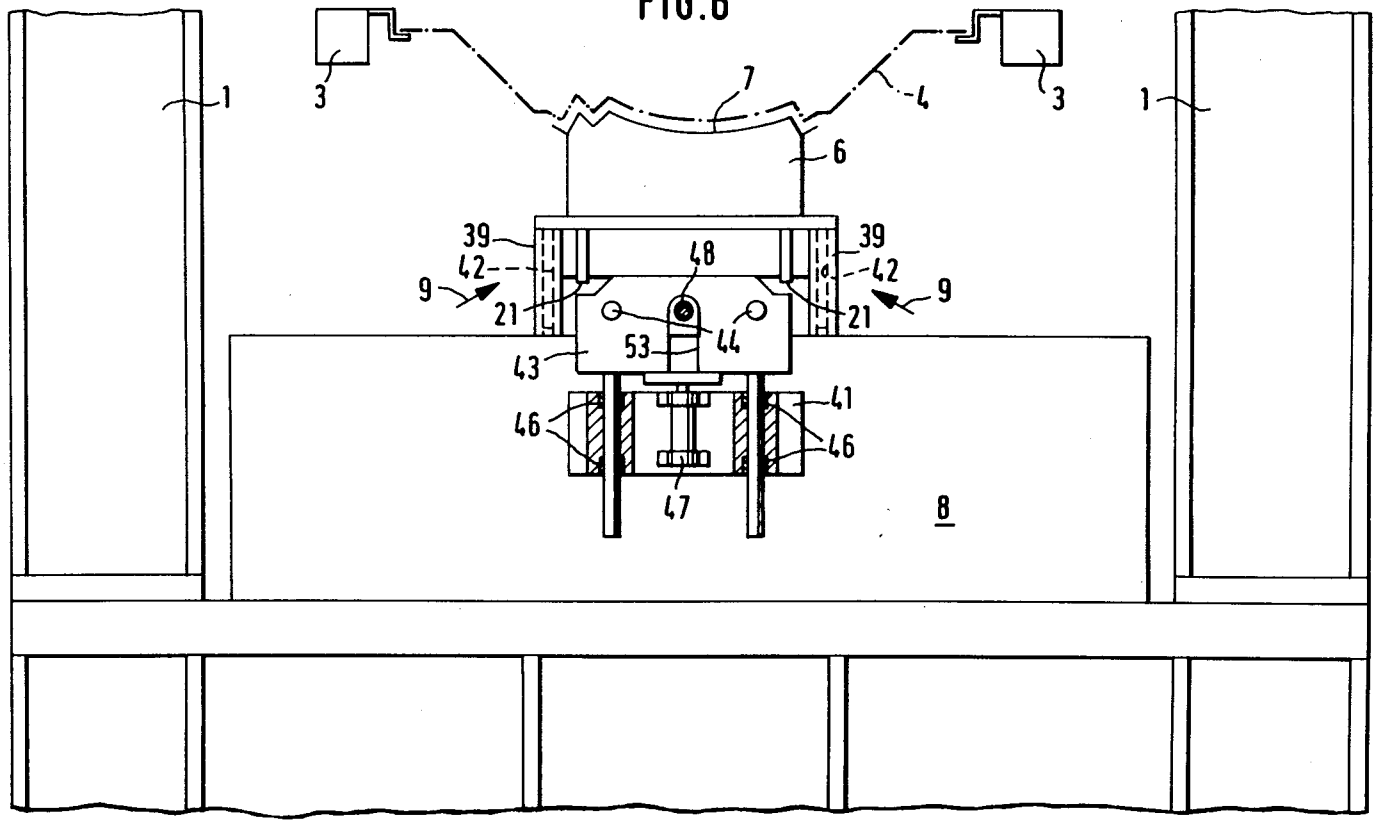

FIG. 6 is a cross-sectional view taken along line VI—VI of FIG. 5.

Referring now to the drawing wherein like reference numerals are used throughout the various views to designate like parts, the intermediate storage is disposed between two columns 1 of a press. The conveyance or transporting direction of the workpieces extends in FIGS. 1, 3 and 6 perpendicularly to the plane of the drawing; in FIGS. 2, 4 and 5, the conveyance direction which characterizes the direction of the workpiece passage is indicated by the arrow 2. The workpieces 4 which are guided into the press, through the press, and possibly out of the same by the conveyance or transporting apparatus, of which are shown the rails 3 carrying the gripping devices, are to be stored within the area between the two columns 1 which are disposed mutually opposite, transversely to the conveyance or transporting direction. Storage templates or jigs 6 serve in that case for the support, whose support surfaces 7, which can also be constructed of several separate parts, correspond to the shape within the support area of the bottom side of the workpiece 4 to be respectively supported. The storage templates 6 may extend in their length dimension in the conveyance direction 2, FIGS. 1 to 4, as also transversely to the conveyance direction 2, FIGS. 5 and 6. The various embodiments illustrate favorable positions of the storage templates 6. However, the present invention is not limited to the indicated closure box 8, its presence or its position. In the various figures, the storage templates 6 are adjustable in height and are divided up into two groups for a mutually spaced support of the workpieces 4. FIGS. 1 to 4 illustrate two storage templates 6 which include at their bottom side pivot bearings 11 within the end areas 9 (FIGS. 2 and 4), of which one pivot bearing is movable in a horizontally extending elongated aperture 12. One bearing bracket 13 each is pivotally connected in each pivot bearing 11, which is guided by way of guide rails 14 in slide guidances 16 of a bearing rail 17 fixed at the frame in FIGS. 1 and 2. The bearing rail 17 may be constructed in one piece per bearing side 18 and 19 and extends thereby essentially over the entire width/length of the support area/of the idling stage. The bearing sides 18 and 19 designate the left, respectively, right support side of the storage templates 6 and the lifting means thereof in FIGS. 2, 4 and 6, respectively, the rear and forwardly disposed support side in FIGS. 1, 3 and 4. The reference numerals 18 and 19 are shown only in FIG. 2 since identical means are used for both support sides in the respective embodiment. Furthermore, a counter-abutment surface 21 is provided at each bearing bracket 13 which cooperates with the piston 22 of an operating cylinder-piston unit 23 or of a corresponding adjusting means for the lifting action. Each operating cylinder-piston unit 23, which will be referred to hereinafter as lifting means, is secured in FIGS. 1 and 2 at a slide carriage 24 which is adapted to be reciprocated in the horizontal direction in slide rails 26 by means of a spindle 27. The spindle 27 is adapted to be rotated in the clockwise and counterclockwise direction by a motor 28. The storage templates 6 which are provided in twice the number of the number of the differently shaped workpieces to be possibly manufactured, are subdivided corresponding to their support positions into groups (in FIGS. 1, 3 and 5, left and right groups, respectively). One lifting means 23 each is coordinated to each end area 9 of each group of storage templates 6. The motor 28, the spindles 27 and the slide rails 26 are secured at the bearing rail 17 by way of bearing angle members 29. A toothed belt drive consisting of toothed belt 31 and gears 32 and 33 serves for the synchronous operation of the slide carriages 24 at the opposite side of the storage templates 6 or two motors 28 are required which act each on a respective spindle 27.

The carriages 24 are adapted to be displaced only when the lowered position of all storage templates or the position of the two last-used storage templates 6 is determined by way of sensing means coordinated to the bearing brackets 13, for example, proximity switches 34. By selection of a pair of storage templates 6 by way of the automation control of the press, the lifting means 23 are adjusted by way of the motor-spindle-carriage-drive, and each piston 22 of the lifting means 23 thereby reaches underneath the counter-abutment surface 21 of the storage template 6 to be lifted.

The height of the counter-abutment surface 21 at the storage templates 6 may differ so that the lifting means has to be displaced in different idling paths up the the abutment at the counter-abutment surfaces. The height of the support surface 7 is adjustable by way of the structural height of the storage templates 6 and the travel of the piston 22 of the lifting means 23 which is still to be traversed up to the abutment.

Figure 1:
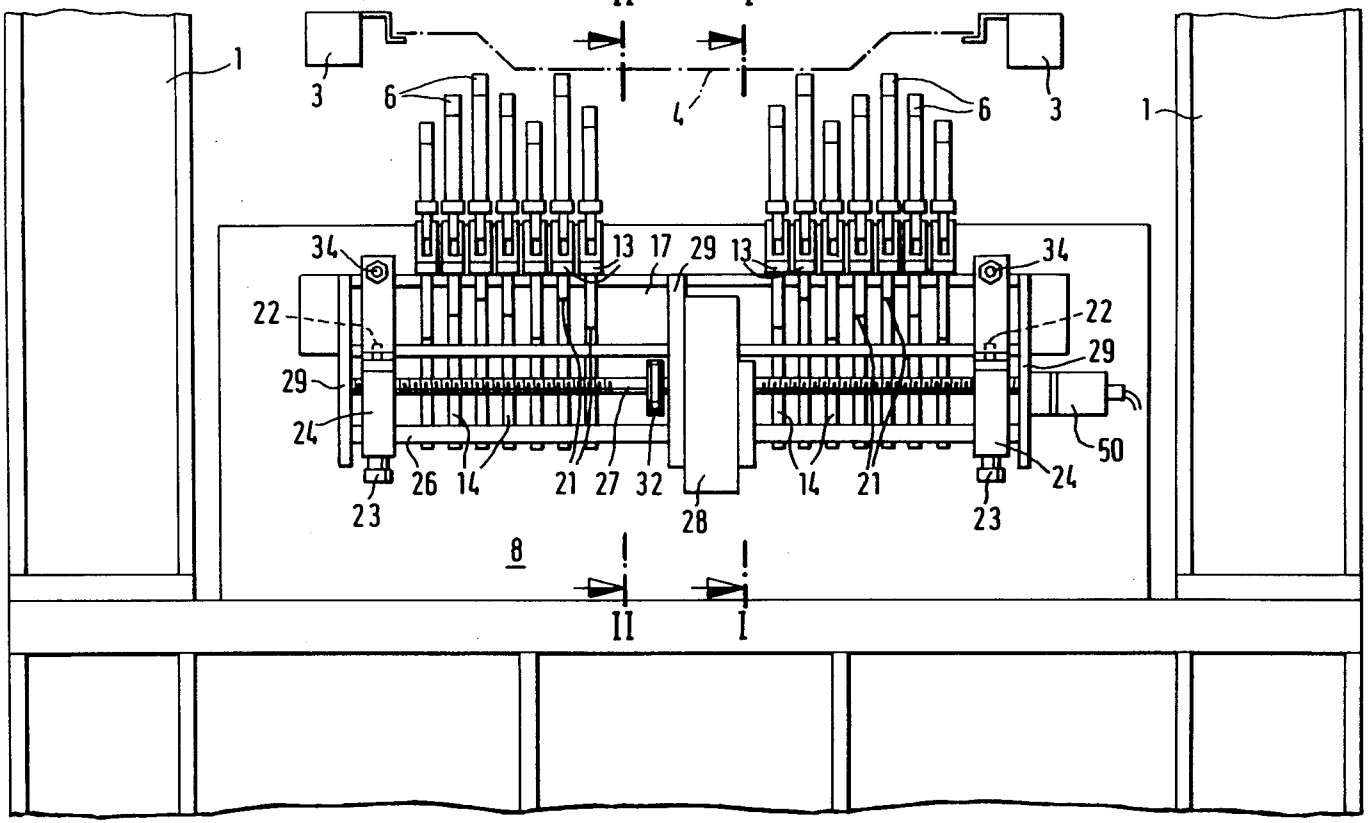
FIG. 1 is a somewhat schematic front elevational view of a first embodiment of an intermediate storage installation in accordance with the present invention.
Figure 2:
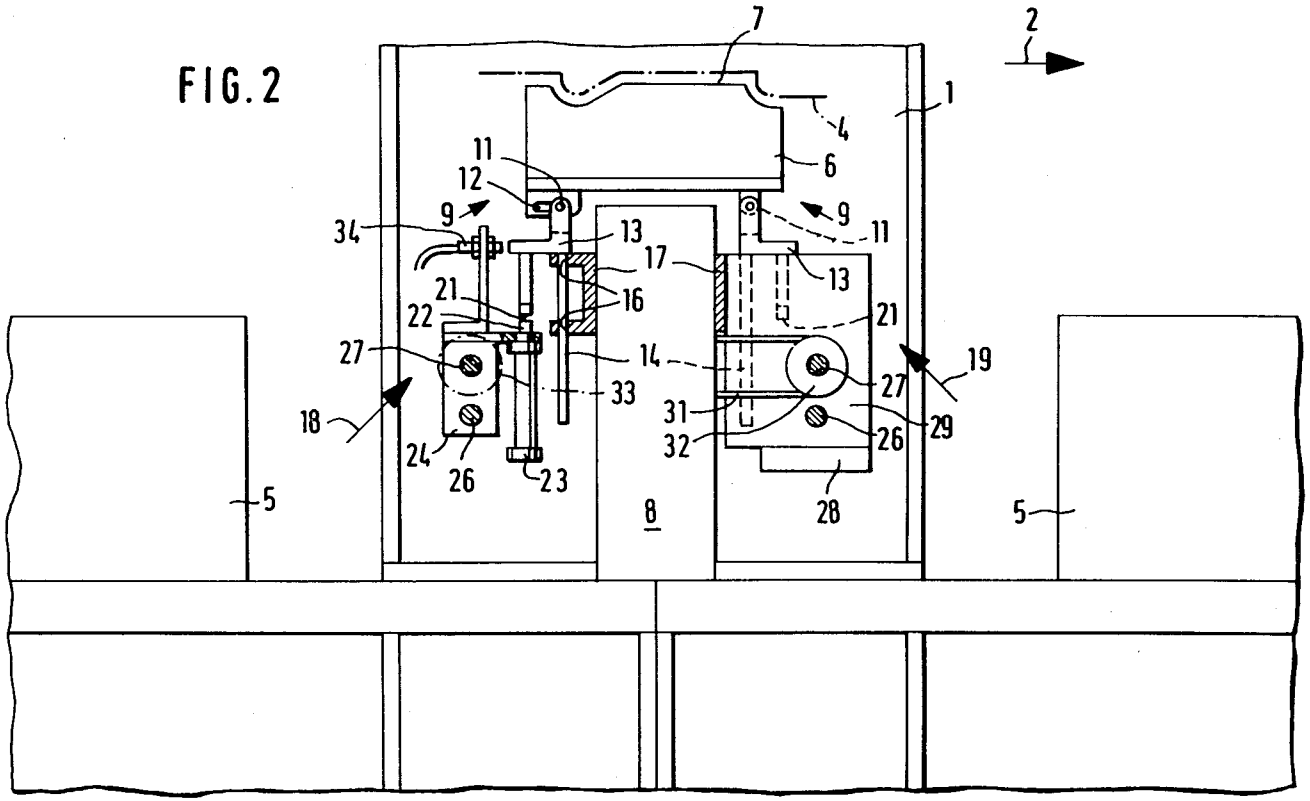
FIG. 2 is a partial cross-sectional view taken along line I—I in FIG. 1 in the left half thereof and a partial cross-sectional view taken along line II—II in FIG. 1 in the right half thereof.
Figure 3:
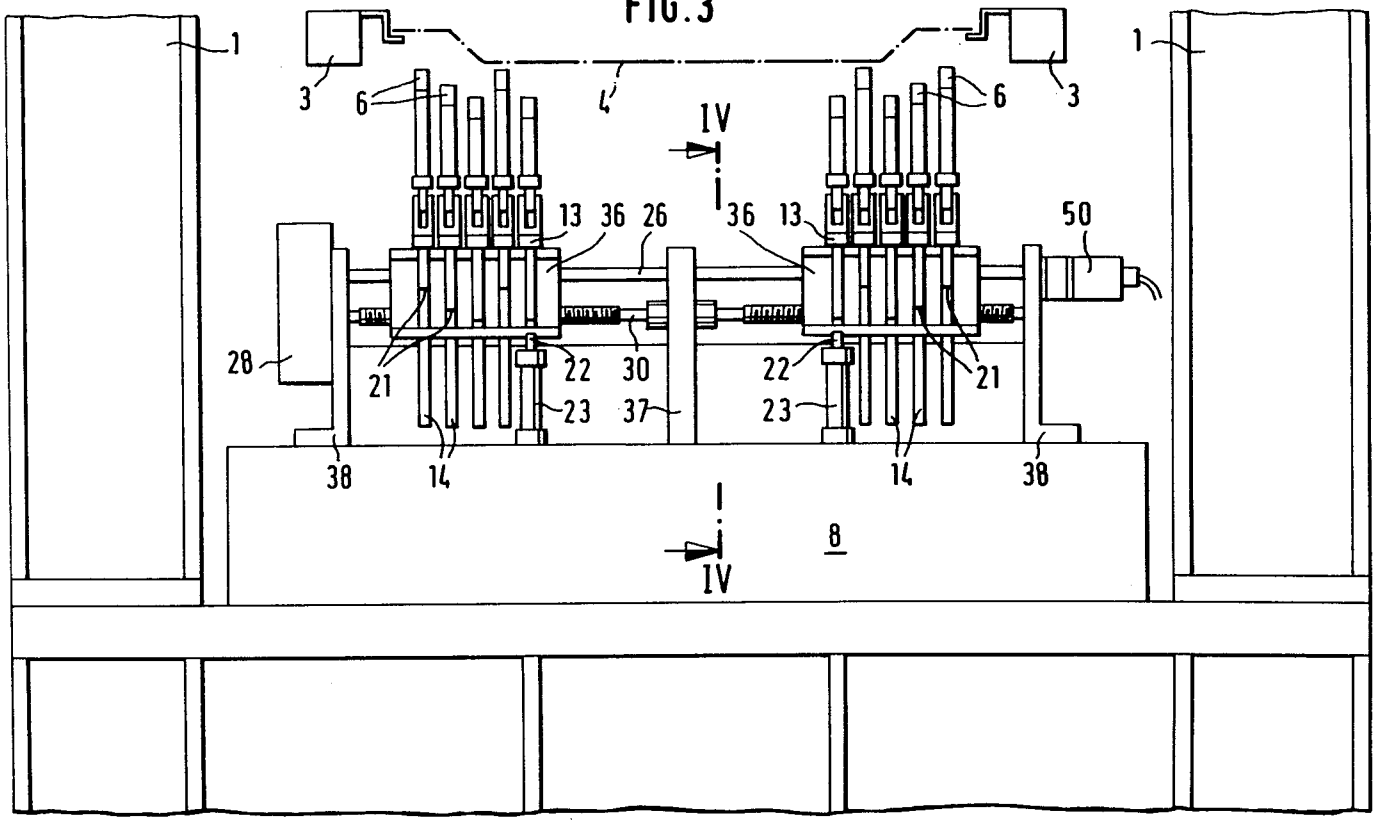
FIG. 3 is a somewhat schematic front elevational view of a second embodiment of an intermediate storage installation in accordance with the present invention.
Figure 4:
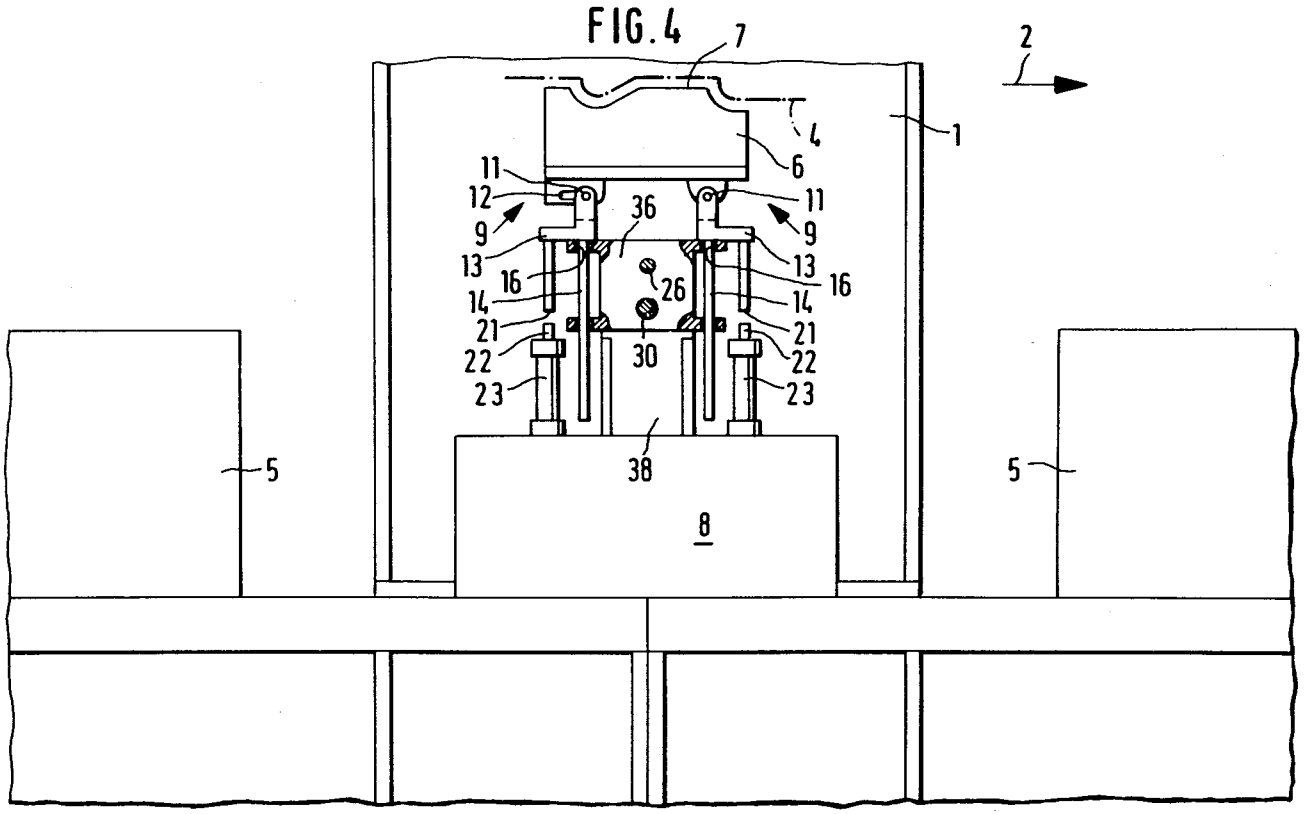
FIG. 4 is a cross-sectional view taken along line IV—IV of FIG. 3.

FIGS. 3 and 4 illustrate similar parts as FIGS. 1 and 2 with the difference that the lifting means 23 are arranged fixed at the frame in the support area common to all (differently shaped) workpieces. Each group of storage templates 6 is thereby adapted to be displaced by itself horizontally by way of a spindle drive in order to place the pair of storage templates 6 to be lifted above the lifting means 23. Each group of storage templates 6 is thereby arranged on a common displaceable carriage 36 whereby each storage template 6 is supported for a vertical movement in the manner described hereinabove. A spingle 30 driven by the motor 28 thereby serves for the drive of the carriages 36, for example, in opposite directions, which is centrally supported in a bearing bracket 37. The storage templates 6 and the drive and bearing means thereof are supported at the frame by way of bearing brackets 38.

A further simplified embodiment of an intermediate storage installation is illustrated in FIGS. 5 and 6 which is secured by way of bearing rails 39 and support plates 41, for example, at the enclosure box 8. Slide guidances 42 for the storage templates 6 to be lifted are provided in the bearing rails 39. A counter-abutment surface 21 is arranged at the bottom side of each storage template 6 in relation to each end area 9. A frame construction consisting of two lateral bearers 43 which are connected with each other by way of two guide rods 44, is arranged underneath the storage templates 6. The frame is (vertically) liftable and lowerable by one or several lifting means 47 fixed at the frame by way of slide guidances, also fixed at the frame, within the area of the lateral bearers 43. A spindle 48 adapted to be driven by the motor 28 is supported centrally which extends in the longitudinal direction of the intermediate storage. An intermediate member 49 movable by way of the spindle 48 in the longitudinal direction of the frame construction is arranged per group of storage templates 6, which cooperates with the counter-abutment surfaces 21 at the selected storage template 6 during actuation of the lifting means 47 in the sense of lifting the storage template 6. The intermediate member 49 is additionally illustrated in FIG. 5*a* rotated through 90°.

The motor 28 and an angular position pick-up or transmitter 50 may be fastened by reference to FIGS. 5 and 6 at the frame construction to be lifted as a whole and are thus to be lifted together with the lifting of a pair of storage templates 6. The motor 28 and the angular position pick-up 50 may, as illustrated in detail in FIGS. 5 and 6, be supported fixed at the frame. For that purpose, sliding blocks 51 are provided in the intermediate members 49 as nuts for the spindle 48. The sliding blocks 51 are guided in vertically extending, elongated apertures 52 of the intermediate members 49. The lateral bearers 43 include corresponding apertures 53 for the free passage of the spindle 48.

The embodiments in FIGS. 5 and 6 include also the possibility of separate drives of, for example, four intermediate members 49 in guide rods 44 which, for that purpose, have, for example, surface guidances or multi-surface guidances, whereby the two intermediate members 49 of a bearing side (18, 19 in FIG. 2) are adjustable by way of a spindle 48 of the illustrated type in a synchronous manner to the two intermediate members 49 of the other bearing side of the illustrated type, which are to be driven by a further spindle 48. Each spindle according to this embodiment is supported motor-driven and parallel to the guide rods 44 and in engagement with one respective intermediate member 49 of each group of storage templates 6 of a bearing side.

The spindles 27, 30 and 48 in FIGS. 1 to 6 and the further embodiments according to FIGS. 5 and 6 are provided, starting from a respective spindle end up to the center of their length, with left, respectively, right hand threads. The illustrated angular position pick-ups 50 serve for the operation of signals corresponding to the rotary position of the spindles (travel distance of the carriages 24, 36, 49) to the press automation control for the control and position of the motors 28. Reference numeral 5 designates tables carrying the work tools which are adapted to be moved out of the press area.

The relative movement—displacement movement—between the storage templates 6 and the lifting means 22, 23, 47 is brought about according to FIGS. 1 and 2 by the motor or the two motors 28, the spindles 27 and the carriages 24, in FIGS. 3 and 4, by the motor 28, the spindle 30 and the carriages 36 and in FIGS. 5 and 6 by the motor 28, the spindle, respectively, spindles 48 and the intermediate members 49.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An intermediate storage mechanism in a transfer press installation having multiple working areas spaced apart from one another for making essentially large and different surface configuration workpieces which are conveyed to an idling stage area between said at least two working areas, comprising: a plurality of storage template means with at least two storage template means per workpiece of different configuration, each of said at least two storage template means having a support surface means matched to a bottom surface of the same workpiece, the storage template means being liftable at least in the generally vertical direction to store a workpiece, lifting means for lifting the said at least two storage template means corresponding to the configuration of the workpiece to be stored, and at least one adjusting means operable to provide a relative movement between the at least two storage template means to be respectively lifted and the lifting means to position the lifting means into lifting position, relative to the at least two template means to be lifted.

2. An intermediate storage mechanism according to claim 1, wherein half the plurality of storage template means are provided in a first group supporting the workpieces within a first area and the other half are provided in a second group supporting the workpieces in a second area located at a distance to the first area, and wherein separate lifting means are provided for each group of storage template means.

3. An intermediate storage mechanism according to claim 2, wherein the number of at least two template means corresponds to the number of different configurations of workpieces to be made in the press.

4. An intermediate storage mechanism according to claim 2, wherein the lifting means are movably supported by way of rail guide means and are synchronously adjustable relative to one another by way of at least one adjusting means.

5. An intermediate storage mechanism according to claim 4, wherein the lifting means are operating cylinder-piston units which are supported at carriage means operable to be driven by way of a spindle drive as adjusting means.

6. An intermediate storage mechanism according to claim 2, wherein each storage template means has two ends, with each end being retained at a respective bearing bracket means by way of a pivot bearing, the lifting means applying a lifting stroke to the bearing bracket means, one pivot bearing for each storage template means being movably supported in an elongated aperture for compensation when differently carried out lifting storkes are utilized, each bearing bracket means being guided in at least one bearing seat means extending in the lifting direction, and each bearing bracket means having within the area of its pivot bearing a counter-abutment surface means for the abutment of the lifting means.

7. An intermediate storage mechanism according to claim 2, wherein the lifting means are operating cylinder piston units fixed at a frame means, and each group of storage template means being adjustable synchronously to one another by way of at least one adjusting means.

8. An intermediate storage mechanism according to claim 2, wherein an intermediate member is arranged at each area of each group of the vertically liftable storage template means between the storage template means and the lifting means, each intermediate member being operable to be displaced into a position to be lifted by the lifting means, and the intermediate members being synchronously displaceable by way of adjusting means.

9. An intermediate storage mechanism according to claim 2, further comprising guide rod means extending essentially over the areas of the template means of both groups, each guide rod being liftable by at least one lifting means, a motor-driven spindle means guided substantially parallel to the guide rod means, and one intermediate member at each area of each group of the template means which is adjustable by spindle means to be positioned relative to the at least two storage template means and liftable by way of the guide rods to lift said at least two storage template means.

10. An intermediate storage mechanism according to claim 2, wherein each storage template means has two ends and a support surface, with each end of the storage template means including a counter-abutment surface means, against which a respective lifting means is adapted to be brought into engagement, and the counter-abutment surface means being adjustable in height to vary the amount of lift given to the support surface of the storage template means in response to a lifting movement of the lifting means.

11. An intermediate storage mechanism according to claim 10, wherein the counter-abutment surface means is brought into operable engagement directly against the lifting means.

12. An intermediate storage mechanism according to claim 10, wherein the counter-abutment surface is brought into operable engagement with the respective lifting means by interposition of an intermediate member.

* * * * *